United States Patent [19]

Baillie

[11] Patent Number: 4,896,968

[45] Date of Patent: Jan. 30, 1990

[54] CEMENT STORAGE AND MIXING SYSTEM

[75] Inventor: Lloyd A. Baillie, Plano, Tex.

[73] Assignee: Atlantic Richfield Company, Los Angeles, Calif.

[21] Appl. No.: 244,588

[22] Filed: Sep. 13, 1988

Related U.S. Application Data

[63] Continuation of Ser. No. 38,693, Apr. 15, 1987, abandoned.

[51] Int. Cl.[4] ..... B01F 13/02; B28C 5/06

[52] U.S. Cl. ..... 366/10; 73/863.85; 366/28; 366/38; 366/50; 366/107; 366/136; 366/140; 406/56

[58] Field of Search ..... 366/28, 50

[56] References Cited

U.S. PATENT DOCUMENTS

| | | | |
|---|---|---|---|
| 216,958 | 7/1879 | Hudson | 366/323 |
| 1,839,456 | 1/1932 | Anderson | 366/107 |
| 1,986,300 | 1/1930 | Stockton | 366/159 X |
| 2,505,125 | 4/1950 | List | 366/88 |
| 2,884,231 | 4/1959 | Pyle et al. | 366/107 |
| 3,148,865 | 9/1964 | McClellan | 366/106 |
| 3,350,070 | 10/1967 | Dostrup | 366/107 |
| 3,583,681 | 6/1971 | Brown | 366/159 X |
| 4,002,325 | 1/1977 | Herfeld | 366/10 X |
| 4,056,981 | 11/1977 | Kalka et al. | 73/863.85 |
| 4,346,652 | 8/1982 | de Ruyter | 366/323 |
| 4,473,300 | 9/1984 | Goins | 366/136 |

FOREIGN PATENT DOCUMENTS

| | | | |
|---|---|---|---|
| 535259 | 1/1957 | Canada | 366/165 |
| 295233 | 8/1928 | United Kingdom | 406/56 |
| 427455 | 4/1926 | Fed. Rep. of Germany | 406/56 |
| 830167 | 1/1952 | Fed. Rep. of Germany | 366/323 |
| 1034464 | 7/1958 | Fed. Rep. of Germany | 366/136 |
| 756745 | 12/1933 | France | 366/156 |
| 1007627 | 5/1952 | France | 366/156 |
| 1230906 | 7/1959 | France | 366/323 |
| 45-3471 | 5/1970 | Japan | 366/107 |
| 60-161722 | 8/1985 | Japan | 366/341 |

*Primary Examiner*—Harvey C. Hornsby
*Assistant Examiner*—Stephen F. Gerrity
*Attorney, Agent, or Firm*—Michael E. Martin

[57] ABSTRACT

A dry bulk cement storage and mixing system comprises one or more generally cylindrical storage tanks or bins having somewhat wedge shaped bottom discharge sections with tapered flight conveyor screws extending across the diameter of the bin at the convergence of opposed sloping sidewalls of the bottom section. The conveyor screw is connected to a pneumatic fluidizing plenum wherein compressed air is introduced into the plenum for conveying material to a mixer or recirculating the material back into a selected storage tank through a distributor device mounted on top of the tank which distributes the material to minimize segregation of smaller or less dense particles during discharge of the material into the storage tank. One embodiment of the storage tank is mounted for rotation about a generally horizontal axis and includes a transversely extending cement unloading and vent conduit extending within the tank chamber. Cement stored within a tank may be sampled by a device which includes an elongated tube extending through a sealable fitting for withdrawing samples of material for analysis of the material mixture within the tank.

8 Claims, 5 Drawing Sheets

CEMENT STORAGE AND MIXING SYSTEM

This application is a continuation, of application Ser. No. 07/038,693, filed Apr. 15, 1987 (abandoned).

BACKGROUND OF THE INVENTION

1. Field of the Invention

The present invention pertains to a dry cement storage and mixing system for handling dry cement having solid additives mixed therein and of a type particularly useful in cementing well casings and the like.

2. Background

In well cementing operations, dry cement having certain solid additives mixed therein is typically stored in one or more bulk storage tanks in the vicinity of the well drilling operation for use in forming a cement slurry which is pumped into the wellbore between the steel casing and the open hole to anchor the casing in place and improve the structural integrity of the formation through which the well has been drilled. Certain problems arise in blending and mixing dry cement compositions prior to the addition of water to the mix. For example, certain solid particle type additives which are blended with the cement itself have a tendency to separate from the cement material due to elutriation because of differences in particle size and due to settling of particles which are of different densities. This settling or segregation of the particles of cement and other additives usually requires additional equipment for reblending of the cement mixture and often results in a poor cement mix lacking the properties required of the material.

The problems associated with providing a properly blended or mixed dry cement material for oil well operations are aggravated by the relatively small capacities of storage vessels which typically must be portable and in certain instances must be designed to be accommodated on offshore drilling vessels or platforms. Moreover, the utilization of pneumatic conveying methods for transporting and mixing dry cement materials also, with conventional storage and handling equipment, tends to promote segregation of the cement by particle size and separation or poor mixing of the cement with the requisite additives used with the cement materials.

The abovementioned problems have been somewhat vexatious to artworkers in the development of cement mixing and storage equipment prior to the development of the present invention.

SUMMARY OF THE INVENTION

The present invention provides an improved cement mixing, storage and dispensing system particularly adapted for handling cement materials utilized in cementing subterranean oil and gas wells, for example.

In accordance with one aspect of the present invention, there is provided a cement storage apparatus which is adapted to discharge or dispense dry bulk cement to a mixing apparatus wherein a greater uniformity of the cement mixture is provided as a result of the configuration of the cement storage vessel and the dispensing apparatus. In accordance with another aspect of the present invention, a cement storage vessel or bin is provided having a unique cement loading or discharge apparatus which distributes the dry bulk cement material into the storage vessel or bin itself in a way that minimizes elutriation or percolation of the cement and additive particles during storage and during withdrawal of the cement from the bin for remixing or for mixing with a hardening agent, such as water.

In accordance with still a further important aspect of the present invention, there is provided a cement storage and mixing system which combines mechanical conveying and pneumatic conveying apparatus in an improved manner which provides for more complete mixing of the cement particles with each other and with certain additive particles which are desired to be blended with the cement particles. The cement storage and mixing system of the present invention combines several elements in a unique system which is particularly useful for storing and mixing cement materials for oil and gas well cementing operations. Those skilled in the art will recognize that the superior features and advantages of the present invention may be used in conjunction with storing and handling cement materials for certain other applications apart from those mentioned herein and the various aspects of the invention will be further appreciated upon reading the detailed description which follows in conjunction with the drawing.

DESCRIPTION OF THE PREFERRED EMBODIMENTS

Figure 1:
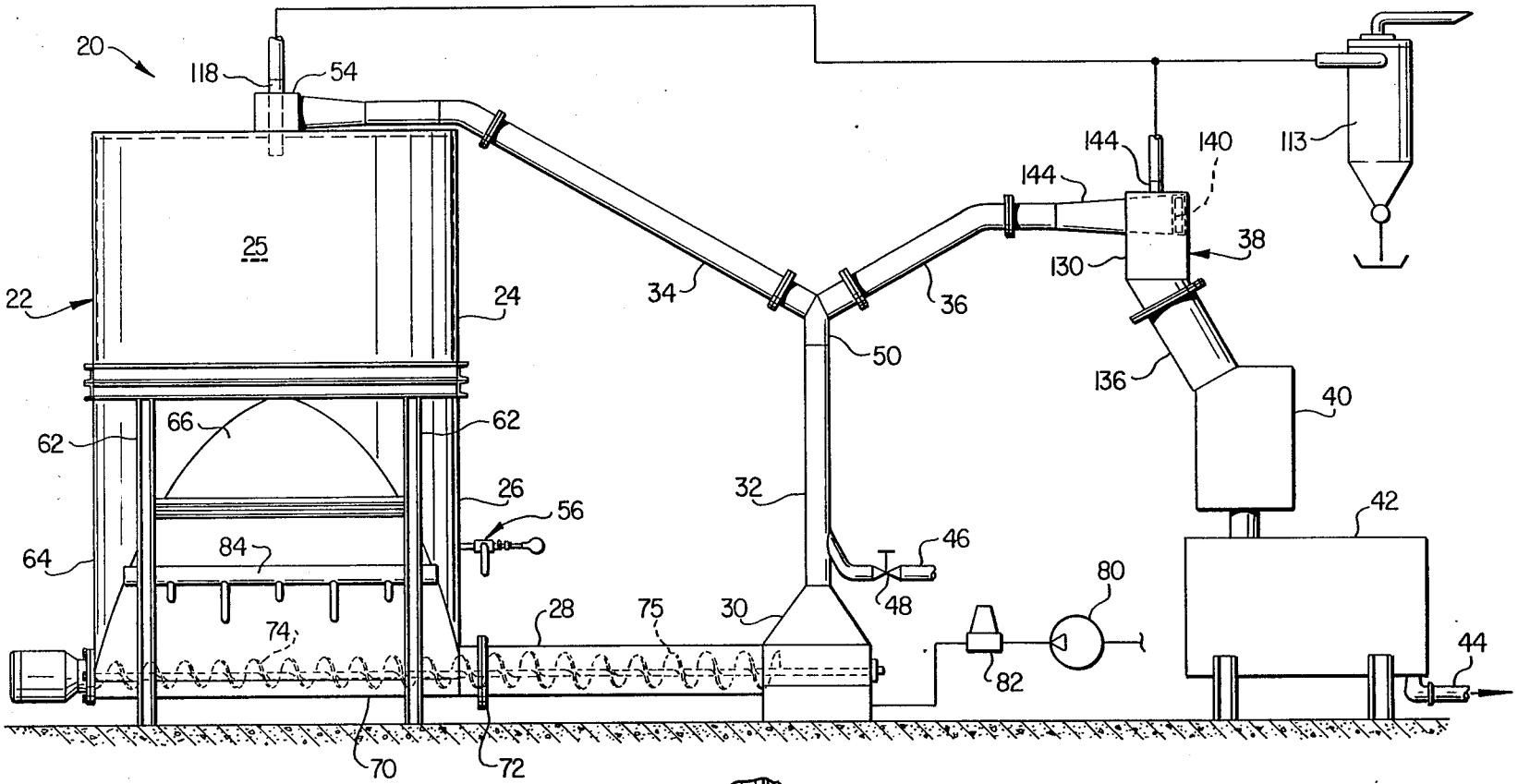
FIG. 1 is a side elevation of one embodiment of a cement storage and mixing system in accordance with the present invention.

In the description which follows, like parts are marked throughout the specification and drawing with the same reference numerals, respectively. The drawing figures are not necessarily to scale and certain features of the invention may be shown in somewhat schematic form in the interest of clarity and conciseness.

Referring to FIG. 1, there is illustrated one preferred embodiment of a cement storage and mixing system, generally designated by the numeral 20 comprising a generally cylindrical storage bin 22 having an upper cylindrical storage section 24 and a lower storage and discharge section 26. The discharge section 26 is connected to a cement discharge conduit 28 which is connected to a fluidizing plenum 30 wherein pressure air is introduced into the plenum for conveying a dry cement mixture through an upstanding conduit 32 connected to a return or cement loading conduit 34 and to a second discharge conduit 36 leading to a separator device 38. Pneumatically conveyed dry cement is separated from the fluidizing and conveying air flow stream in the separator 38 and dry bulk cement may be discharged through a flow meter 40 into a conventional cement mixer 42 wherein water and other liquids are added to the dry cement to form a mix which is conducted through a discharge conduit 44 to a suitable point of use, not shown.

Dry cement and other particulate material may be initially loaded into the bin 22 through a conduit 46 connected to the conduit 32 and having a suitable shut-off valve 48 interposed therein. Moreover, the conduits 32, 34 and 36 are each connected to a directional valve fitting 50, to be described in further detail herein, for diverting the dry cement flow stream selectively into the conduit 34 or the conduit 36. The conduit 34 is connected to the bin section 24 through a unique distributor device, generally designated by the numeral 54, which will also be described in further detail herein. The composition of the cement stored in the bin 22 may be analyzed from time to time by a cement sampling apparatus 56 disposed on the lower bin section 26 and which also will be described in further detail herein.

Figure 2:
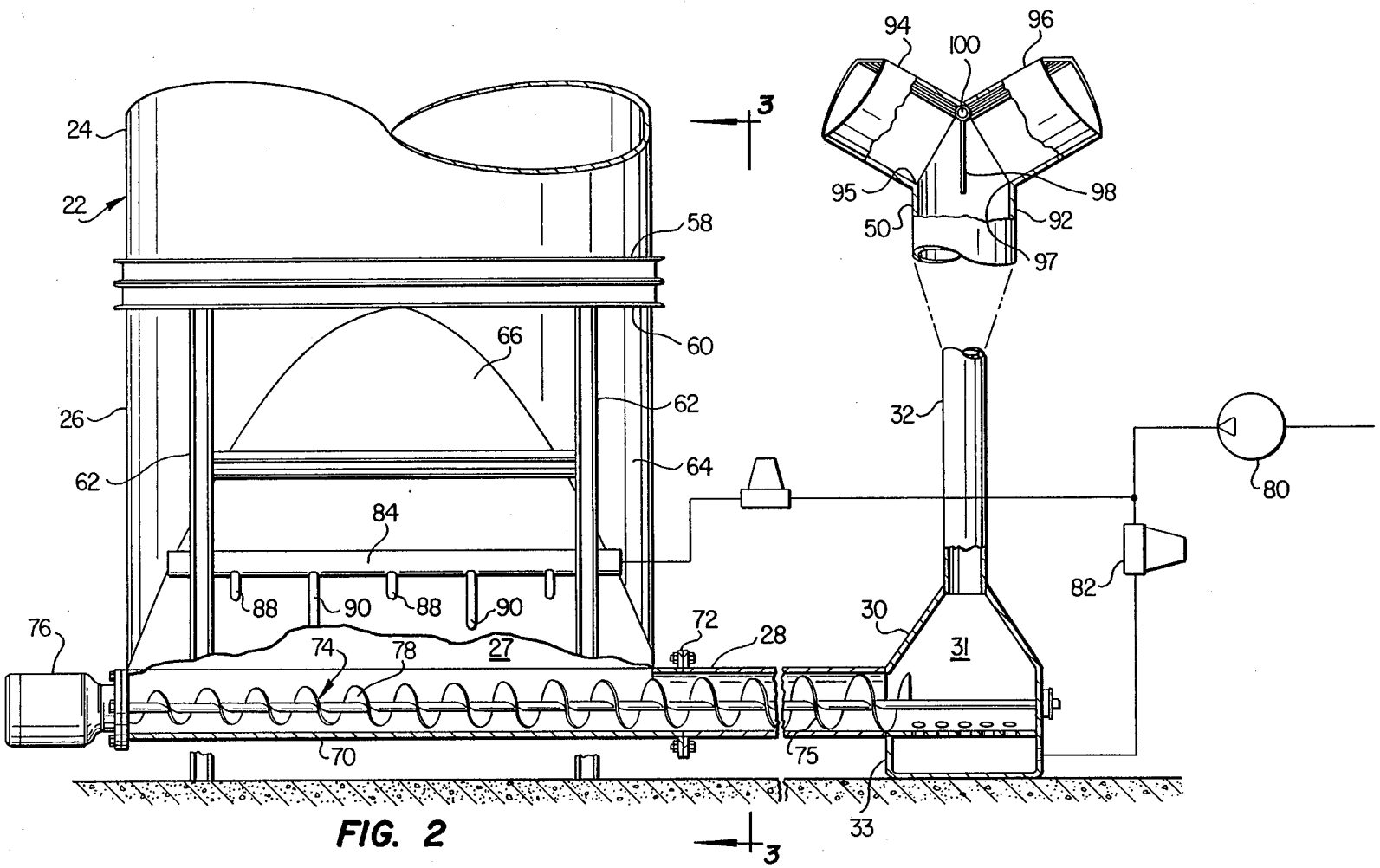
FIG. 2 is a detail elevation view, partially sectioned, of the storage bin and screw conveyor discharge mechanism of the system illustrated in FIG. 1.
Figure 3:
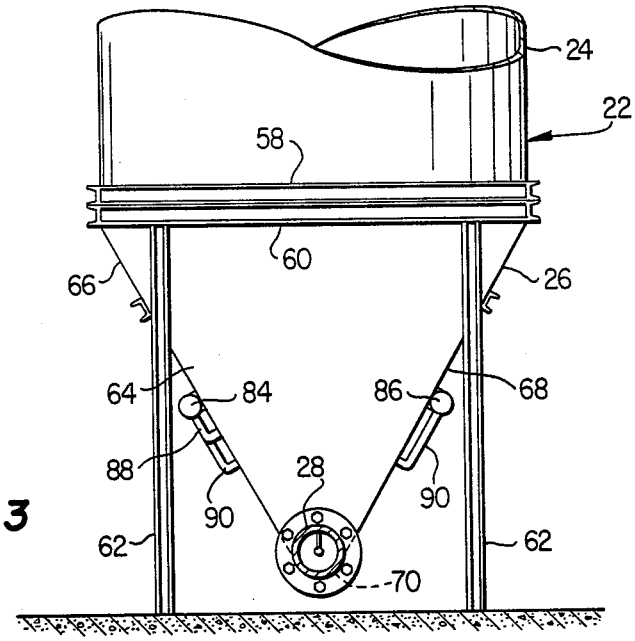
FIG. 3 is a view of the storage bin taken from the line 3—3 of FIG. 2.

Referring now to FIGS. 2 and 3, the storage bin 22 is preferably constructed so that the upper section 24 may be detachably secured to the lower section 26 at mating cylindrical flanges 58 and 60, respectively. Accordingly, either of the upper or lower bin sections 24 and 26 may be interchanged with similar bin sections, not shown, of greater or lesser capacity, as desired. The lower bin section 26 is preferably supported on spaced apart upstanding legs 62 which may be fabricated from conventional structural metal members. The lower bin section 26 is defined by a generally cylindrical wall 64 which is intersected and delimited by opposed converging planar wall sections 66 and 68 which are joined to the cylindrical wall 64 at the respective lines of intersection. For a storage bin for dry bulk cement having certain additives such as fluid loss control additives, hardening accelerators or retarders and the like, the sloping walls 66 and 68 should extend in planes which form an angle of from 60° to 75° from the horizon.

The sloping walls 66 and 68 are joined together at a generally cylindrical bottom wall or trough section 70 which is preferably about the same diameter as the conduit 28 and is suitably connected to the conduit at a flanged connection 72, FIG. 2. The trough 70 houses an elongated conveyor screw 74 which is operably connected to a pressure fluid driven motor 76 mounted on the bin section 26 opposite the conduit 28. The conveyor screw 74 is of a type having at least one flight 78 which is tapered along the portion of the flight extending across the bin section 26 for conveying cement from the interior chamber 27 of the bin section 26 into the conduit 28. The conveyor screw 74 has a full diameter section 75 extending within the conduit 28 in close fitting relationship to the well of the conduit to prevent backflow of material from the plenum 30 into the bin section 26. The provision of the tapered bin section 26, having the opposed planar converging walls 66 and 68 which converge toward the conveyor screw 74, and the provision of the tapered flight type screw provides for uniform discharge of the material stored in the bin section 26. Accordingly, assuming that there is uniform distribution of the components of the cement in the chamber 27, the configuration of the bin section 26 and the conveyor screw 74 assure that uniformly mixed cement is discharged into the conduit 28 and also that the entire inventory of cement in the bin 22 may be recirculated and thoroughly mixed with the system of the present invention.

As shown in FIG. 2, the discharge plenum 30 defines an interior chamber 31 into which the conveyor screw 74 extends and terminates. A pressure air manifold 33 is formed on the plenum 30 and is connected to a suitable pressure air source 80 for providing conveying air to the manifold 33 through a suitable pressure regulator valve 82. Accordingly, dry cement may be discharged from the storage bin 22 through the conduit 28 by rotation of the conveyor screw 74 whereupon the cement may be fluidized in the plenum 30 and conveyed through the discharge conduit 32 for recirculation back to the bin 22 or for discharge to the cement mixing system illustrated in FIG. 1. Uniform mixing of the cement stored in the bin section 26 and improved flowability of the cement for discharge from the bin section 26 is provided by elongated pressure air supply manifold members 84 and 86, FIG. 3, which are adapted to discharge low pressure air into the chamber 27 through respective conduits 88 and 90. The manifolds 84 and 86 are adapted to be suitably connected to the pressure air source 80. The manifolds 84 and 86 also advantageously serve as stiffening members for the sloping sidewall members 66 and 68.

Referring further to FIG. 2, the diverter valve fitting 50 is characterized by a relatively short cylindrical inlet pipe section 92 which is adapted to be connected to the conduit 32 and which intersects opposed generally half-elliptical shaped discharge conduit portions 94 and 96 which may be fashioned with short transition sections, not shown, for connecting the fitting 50 to the conduits 34 and 36, respectively. A flow diverter valve closure member or vane 98 is hinged at 100 at the juncture of the conduit portions 94 and 96 and is adapted to be positioned to progressively close off the flow passages defined by the conduit portions 94 and 96 to divert the cement flow either to the conduit 34 or the conduit 36 in selectively controlled amounts to each conduit, respectively. Accordingly, during cement mixing operations for providing cement to the mixer 42, at least a portion of the cement may be recirculated back to the bin 22 to enhance the thoroughness of the mix and further avoid any adverse effects from elutriation or percolation of the particles of cement and cement additives which may be of different size and density. The valve member 98 may, of course, be disposed completely across the respective openings 95 or 97 to shut off flow to the conduit 34 or the conduit 36 as required. Alternatively, the fitting 50 may be replaced by a conventional tee fitting with suitable flow control valves interposed in each branch of the tee fitting.

Figure 4:
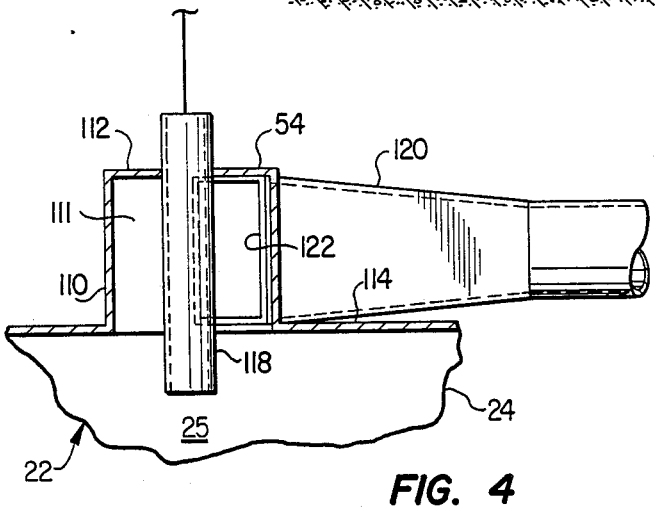
FIG. 4 is an elevation, partially sectioned, of the cement distributor device for the storage bin illustrated in FIGS. 1 and 2.
Figure 5:
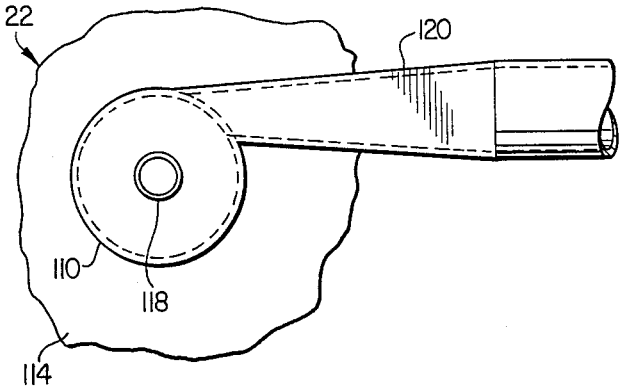
FIG. 5 is a plan view of the distributor device illustrated in FIG. 4.

When materials such as fine particulate dry cement are being loaded into a storage bin or the like by conventional methods, the material tends to accumulate in the bin in the form of a generally conically shaped pile. If the material particles are of various densities and/or particle sizes, the lighter particles tend to slide or tumble down the surface of the pile and be disposed adjacent the outer wall of the storage bin, thereby resulting in non-uniform distribution of the material when discharged from the bin. In accordance with the present invention, an improved distribution device is provided for distributing fine particulate dry material such as cement into a generally cylindrical bin such as the bin 22. Referring now to FIGS. 4 and 5, the distribution fitting or device 54 is characterized by a generally circular housing member 110 having a top transverse wall 112. The housing 110 may be formed as a part of the top wall 114 of the bin section 24 as illustrated. A generally cylindrical vent conduit 118 extends from within the bin chamber 25 through the top wall 112 and is suitably connected to a fine particle separator 113, see FIG. 1. The vent conduit 118 is provided for venting pressure air from the interior of the storage bin 22 when cement is being distributed into the chamber 25 during loading of the bin 22 or during recirculation of the cement stored in the bin for thorough mixing or remixing of the cement material and its associated additives. The distribution fitting 54 includes a generally tangential inlet conduit portion 120 which forms a transition from the cylindrical conduit 34 to a generally rectangular opening 122 which goes into the interior chamber 111 of the housing member 110. Fluidized dry cement material being discharged into the chamber 111 flows in a generally vortiginous manner through the chamber and due to gravitational forces tends to drop downwardly into the chamber 25. However, the centrifugal forces exerted on the cement and additive particles as they enter the chamber 111 are such as to cause the material to flow outwardly toward the sidewall of the bin section 24 to provide a more thorough and even distribution of the cement material being discharged into the bin section 24. In this way, the distribution of cement and additive particles is more uniform than with a central or offset but generally downward extending inlet opening which would tend to allow cement to accumulate in the bin in a generally conical pile.

Figure 6:
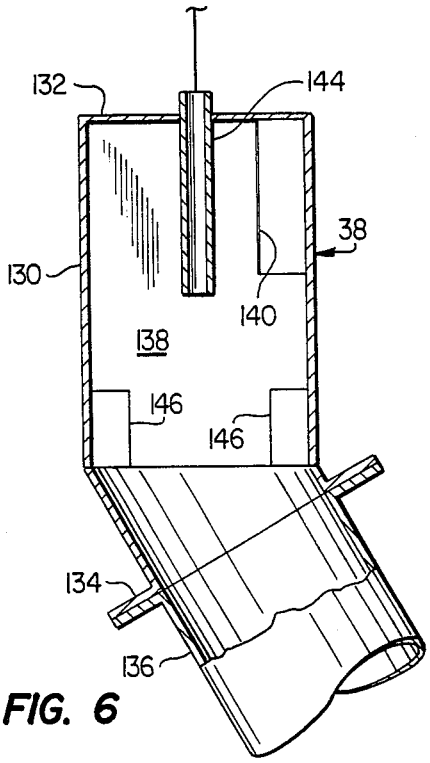
FIG. 6 is a section view of a cement-conveying air separator device for the storage and mixing system.

Referring now briefly to FIG. 6, the separator device 38 is also characterized by a generally cylindrical housing member 130 having a transverse top wall 132 and a lower peripheral flange 134 for connecting the separator device to a cement discharge conduit 136. The housing member 130 defines an interior chamber 138 which is in communication with a tangential inlet opening 140 formed by a conduit section 142, FIG. 1, which forms a transition from the generally cylindrical conduit 36 to the generally rectangular inlet opening 140. A pressure air discharge conduit 144 depends from the transverse top wall 132 into the chamber 138 preferably below the bottom of the inlet opening 140. The conduit 144 is also suitably connected to the separator 113. Circumferentially spaced and radially inwardly extending flow straightening vanes 146 are disposed such as to extend radially inward from the side wall of the housing member 130 to provide means for de-swirling the flow of cement entering the housing 130 and being separated from the conveying air flow stream which introduces the fluidized cement material into the chamber 138 in a vortiginous manner.

Referring again to FIG. 1, operation of the storage and mixing system 20 is believed to be evident to those skilled in the art from the foregoing description. However, briefly, dry bulk cement may be loaded into the bin 22 through the conduit 46 by moving the valve closure member 98 to a position to block flow into the conduit 36 and provide full flow of cement through the conduit 34 to the distributor 54. Cement is loaded into the bin 22 in a uniformly distributed manner by operation of the distributor apparatus 54 to minimize the effect of unwanted distribution of the finer particles toward the outside wall of the bin. In order to minimize the effects of elutriation or percolation, cement and any additives mixed therewith and stored in the bin sections 24 and 26 may be recirculated at will by operation of the conveyor screw 74 to discharge material from the bin section 26 into the plenum 30 whereby pressure air may be utilized to convey the material back into the bin through the conduits 32 and 34. When it is desired to supply cement to the mixer 42 the position of the closure member 98 may be adjusted to provide partial recirculation of cement back into the bin 22 and discharge of at least some of the cement through the conduit 36 to the separator 38 and the mixer 42. In this way, the cement may be continuously remixed and also discharged to the mixer 42 so that the cement particles and the additives are evenly distributed in the mixture which is flowing to the mixer.

Figure 7:
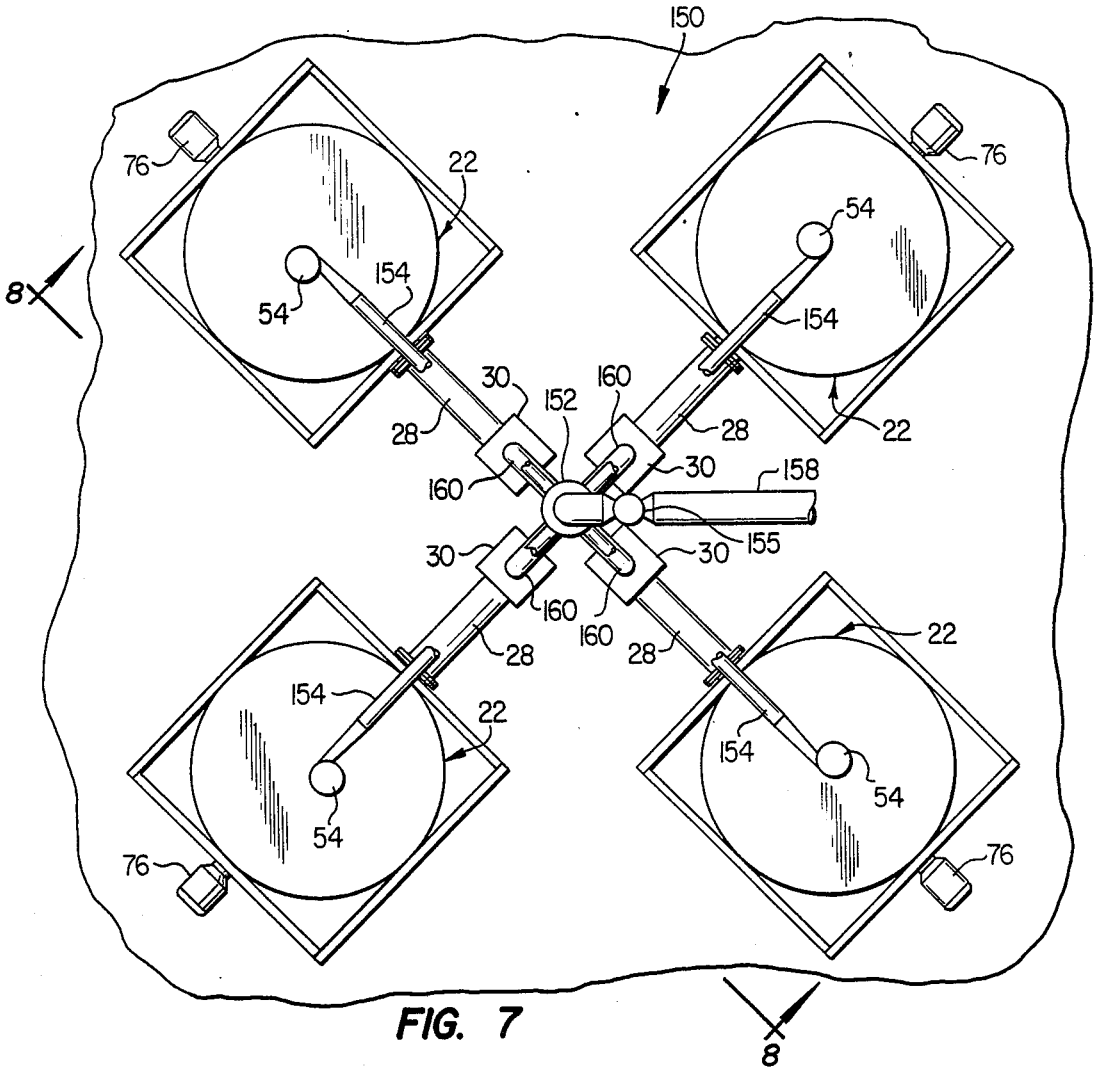
FIG. 7 is a plan view of another embodiment of a cement storage and mixing system in accordance with the present invention.
Figure 8:
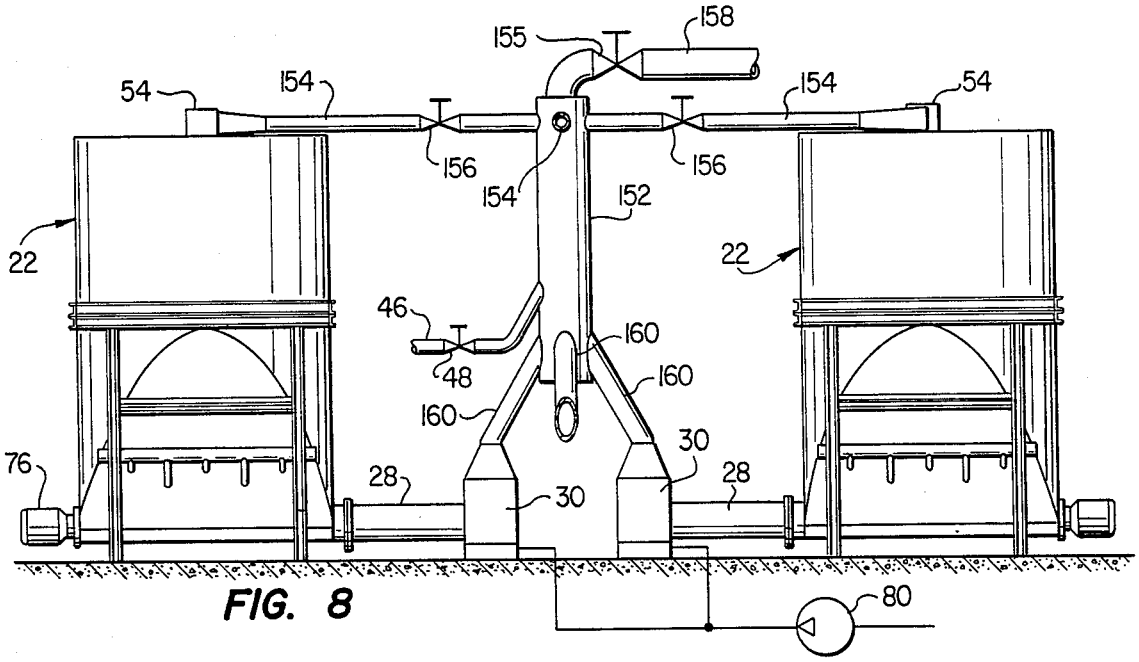
FIG. 8 is a side elevation of the system illustrated in FIG. 7 and taken along line 8—8 of FIG. 7.

Referring now to FIGS. 7 and 8, an alternate embodiment of a cement storage and mixing system in accordance with the present invention is illustrated and generally designated by the numeral 150. The storage and mixing system 150 includes a plurality of cement storage bins or tanks 22 arranged, by way of example, in a generally square pattern. Each of the storage bins 22 is provided with a distribution device 54 operably connected to a vertically extending cement discharge conduit 152 by way of respective branch conduits 154. Each of the conduits 154 has a suitable shut-off valve 156, FIG. 8, interposed therein between the distribution devices 54 and the point of connection with the discharge conduit 152. The discharge conduit 152 includes a section 158 which leads to a suitable separator, not shown, or other apparatus for handling dry cement mixes discharged from one or more of the bins 22.

The bins 22 are also in communication with the discharge conduit 152 by way of their respective conveyor discharge conduits 28 and fluidizing plenums 30 which are each connected to the conduit 152 by respective conduit sections 160.

The operation of the system 150 is similar to that of the system 20 in that selected ones of the storage bins 22 may be operated to discharge their contents through their conveyor screw conduits 28 and fluidizing plenums 30 into the discharge conduit 152. By selectively opening and closing the valves 155 and 156, cement may be recirculated back to the bins 22, from one bin to another, or from selected ones of the bins to the final discharge conduit 158 for utilization of the cement as required. In this way, different blends of cement may be stored in selected ones of the storage bins 22, or the bins may have certain cement additives stored therein for mixing with material stored in others of the bins 22. Thanks to the configuration of the conveyor screw conduits 28 and the fluidizing plenums 30, precisely controlled quantities of cement with or without additives may be discharged from selected ones of the bins 22 and conveyed pneumatically back to further selected ones of the bins 22 or through the discharge conduit 158.

Figure 9:
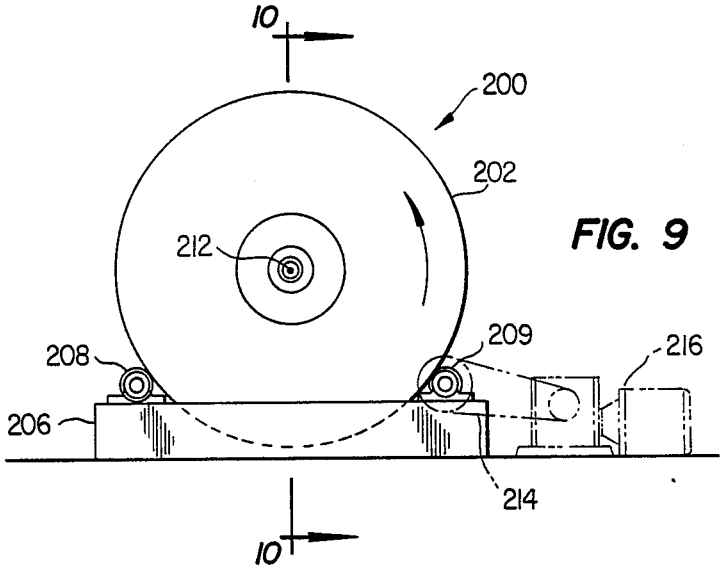
FIG. 9 is an end view of a rotating cement storage bin in accordance with the present invention.
Figure 10:
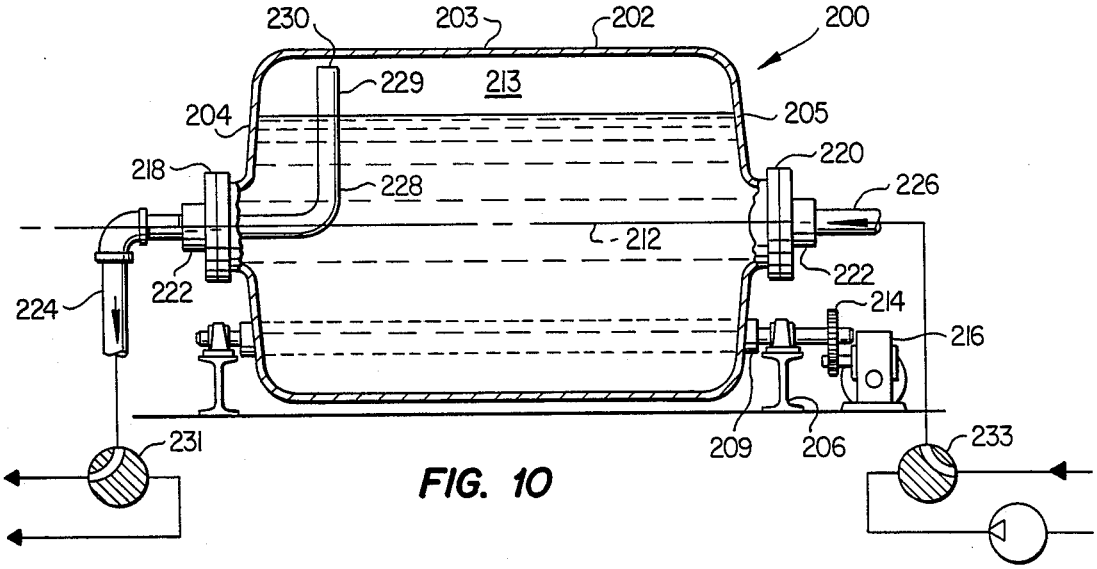
FIG. 10 is a section view taken along the line 10—10 of FIG. 9.
Figure 11:
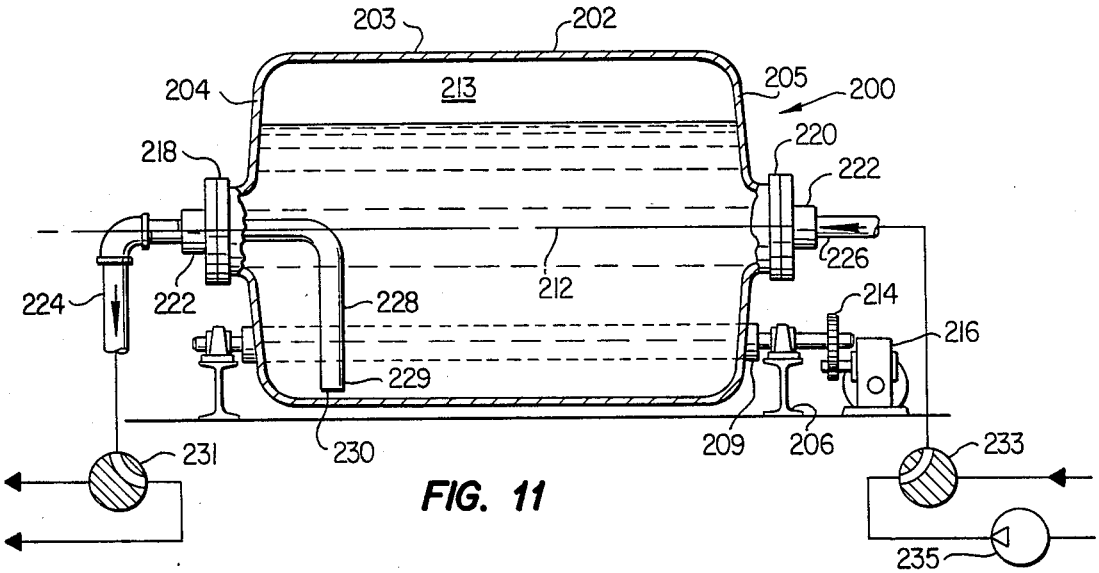
FIG. 11 is a view taken along the same line as the view of FIG. 10 showing the rotating bin in a different position.

Referring now to FIGS. 9 through 11, there is illustrated a rotating cement storage and blending or mixing bin, generally designated by the numeral 200. The storage bin 200 includes a generally cylindrical rotatable tank 202 having a cylindrical sidewall 203 and opposed end walls 204 and 205. The tank 202 is disposed on a frame 206 which supports spaced apart elongated rollers 208 and 209 which, in turn, support the tank 202 for rotation about a generally horizontal central axis 212. At least one of the rollers, such as the roller 209, is rotatably driven through a suitable mechanical power train including an endless belt or chain 214 drivenly connected to a prime mover 216.

Referring to FIGS. 10 and 11, in particular, the end walls 204 and 205 are each provided with central, generally circular flanges 218 and 220. The flanges 218 and 220 are each suitably coupled to respective rotary unions 222 which in turn are connected to respective conduits 224 and 226. The flange 218 is also connected to a conduit 228 extending within the interior chamber 213 of the tank 202 and extending generally normal to the rotational axis 212 to an opening 230 disposed adjacent the cylindrical sidewall 203. The conduit 228 is fixed in relation to the tank 202 and rotates therewith whereas the conduits 224 and 226 are arranged to permit rotation of the tank without rotating either of these conduits, thanks to the provision of the rotary unions 222.

The bin or tank 202 may be rotated at will by the prime mover 216 to mix the contents thereof to minimize the effects of elutriation or percolation of cement and certain additive particles.

Referring now to FIG. 10, when it is desired to load pneumatically conveyed cement into the tank 202, the tank is positioned in a manner as shown in FIG. 10 such that the transverse leg 229 of the conduit 228 is extending vertically upward so that the conduit serves as an air escape vent for the fluidizing and conveying air used to convey cement into the chamber 213. Pneumatically conveyed cement is discharged into the tank 202 from a source, not shown, by way of valve 233 and through the conduit 226 and settles into the chamber 213 due to gravitational forces while air separated from the cement is allowed to be vented through the conduits 228 and 224 and a valve 231 to a suitable filter or fines separator, not shown.

Referring now to FIG. 11, the storage tank 202 is shown rotated approximately 180° so that the opening 230 for the conduit 228 is disposed facing downwardly and the conduit 224 has been selectively placed in communication with means, not shown, for receiving a flow of fluidized cement by way of valve 231. At the same time, the conduit 226 has also been selectively placed in communication with a source of fluidizing and conveying pressure air 235 which enters the chamber 213 and fluidizes the contents thereof for discharge from the chamber through the conduits 228 and 224. Of course, the tank 202 may be rotated while air is being pumped into the chamber 213 to assist in the fluidizing and mobilizing action of the cement and to more thoroughly mix the cement prior to discharge from the tank through the conduit 224.

Figure 12:
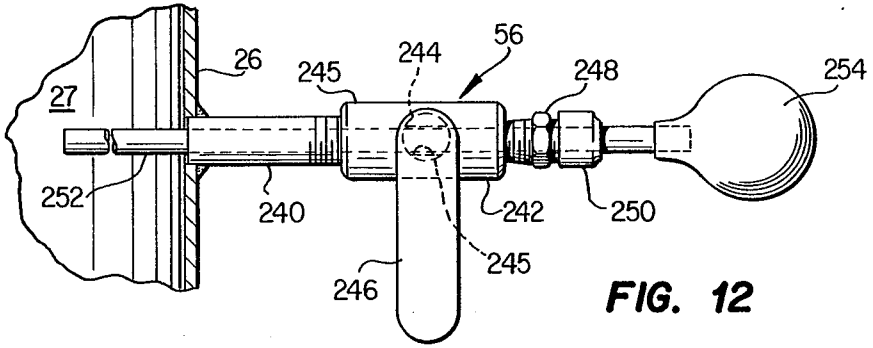
FIG. 12 is a side elevation of a cement sampling device in accordance with the system of the present invention.

Referring now to FIG. 12, there is illustrated a preferred embodiment of the cement sampling fitting 56 for the tank or bin 22. Those skilled in the art will appreciate that the fitting 56 may be utilized in conjunction with the storage bin or tank 202 as well as similar cement or dry bulk material storage vessels. The so-called thief sampling fitting 56 includes a substantially rigid conduit section 240 which is connected to a conventional ball valve 242 having a rotatable ball closure member 244 disposed in a housing 245 and operably connected to an operating handle 246. The ball valve 242 is also connected to a threaded tubing fitting 248 which may be of the flareless hydraulic type and comprising an externally threaded connector member which is adapted to receive a nut 250 for securing an elongated tube 252 which extends through a bore 245 formed in the closure member 244 and through the conduit 240 into the interior chamber 27 of the bin section 26. A flexible bulb 254 is connected to the outer end of the tube 252 for use in filling the tube with a sample of material taken from the chamber 27 whereupon the nut 250 may be loosened to selectively position or withdraw the tube and the bulb from the ball valve 242. After withdrawal of the tube 252, the closure member 244 may be rotated to block the flow of cement or pressure air out of the chamber 27. The provision of the fitting 56 allows material samples to be taken, depending on the insertion length of the tube 252, of the contents of the chamber 27 across the width of the chamber at selected points at predetermined times and regardless of whether or not cement is being loaded into the bin 22 or being discharged therefrom.

Although preferred embodiments of the present invention have been described in detail herein, those skilled in the art will recognize that various substitutions and modifications may be made to the embodiments shown and described without departing from the scope and spirit of the invention as recited in the appended claims.

What I claim is:

1. A system for storing and discharging dry blended cement material comprising a mixture of cement particles and at least one additive comprising dry particulates wherein said cement particles and said particulates are of at least one of different size and density, said system being adapted to minimize separation of said mixture by at least one of elutriation and percolation, said system comprising:

at least one storage bin including means forming a transverse top wall, a cylindrical sidewall and opposed wall portions converging toward each other and defining a material receiving chamber, and bottom trough means defining a discharge opening to provide for discharge of said mixture from said chamber;

material distribution means in communication with said chamber for distributing said material into said chamber in such a way as to minimize separation of relatively lighter weight particles from heavier particles in said mixture during discharge of said mixture into said bin;

a discharge conduit in communication with said bottom trough for conducting said mixture from said chamber; and conveyor means extending substantially across said chamber, said conveyor means comprises a conveyor screw extending within said bottom trough and having a flight which tapers radially inwardly with respect to the axis of rotation of said conveyor screw from a point adjacent said discharge conduit toward an opposite end of said bottom trough for withdrawing said mixture from said chamber in such a way that the material disposed in said chamber is withdrawn from said chamber substantially uniformly across said chamber due to the progressively increasing swept volume of said flight so as to remix particles of said mixture of said at least one of said different size and density and which have separated in said chamber due to said at least one of elutriation and percolation.

2. The system set forth in claim 1 wherein:

said distribution means comprises a generally cylindrical housing disposed on said topwall and centrally located with respect to said cylindrical sidewall, a material inlet duct arranged to introduce said mixture into said housing generally tangentially with respect to a central axis of said housing and for disturbing said mixture generally radially outwardly toward said sidewall.

3. The system set forth in claim 1 including:

means opening into said chamber for conducting fluidizing air into said chamber during discharge of material from said bin.

4. The system set forth in claim 1 including:

a plenum connected to said discharge conduit for receiving material from said chamber, a plenum discharge conduit, means for introducing fluidizing air into said plenum for pneumatically conveying said mixture to said plenum discharge conduit; and a loading circuit connected to said plenum discharge conduit for conveying said material to said mixture distribution means.

5. The system set forth in claim 4, wherein:

said system includes a plurality of said bins, each of said bins having a discharge conduit and conveyor means for conveying material to said plenum for fluidizing said material and pneumatically conveying said material; and material loading conduits connected to said plenum discharge conduit and to each of said bins, respectively, for circulating material to selected ones of said bins to selectively load material into said bins and to remix said mixture during loading and storage of said mixture in said selected ones of said bins.

6. The system set forth in claim 5 wherein:

each of said bins includes material distribution means for receiving material circulated to said bins and to provide for substantially uniform distribution of said mixture into said bins during circulation to said selected ones of said bins.

7. The system as set forth in claim 1 including:

material sampling means connected to said bin for withdrawing samples of material in said bin at selected locations in said bin, said sampling means comprising:

a valve housing connected to said bin and supporting a valve closure member;

an elongated sampling tube extending through said closure member and into a chamber in said bin;

means for selectively positioning said tube in said chamber and for securing said tube to said valve housing; and mean for withdrawing a sample of material from said chamber into said tube.

8. A system for storing and discharging dry blended cement material comprising dry particulates wherein said cement particles and said particulates are of at least one of different size and density, said system being adapted to minimize separation of said mixture by at least one of elutriation and percolation, said system comprising:

at least one storage bin including means forming a transverse top wall, a cylindrical sidewall and sloping bottom wall portions defining a material receiving chamber;

material distribution means in communication with said chamber for distributing said material into said chamber in such a way as to minimize separation of relatively lighter weight particles from heavier particles in said mixture during discharge of said mixture into said bin, said distribution means comprising a generally cylindrical housing disposed on said top wall and centrally located with respect to said cylindrical sidewall, a material inlet duct arranged to introduce said mixture into said housing generally tangentially with respect to a central axis of said housing and for distributing said mixture generally radially outwardly toward said sidewall;

conveyor means including a tapered flight screw extending across a bottom portion of said chamber for withdrawing said mixture from said chamber substantially uniformly across said chamber to remix particles of said mixture which have separated in said chamber due to said at least one of elutriation and percolation;

a discharge conduit in communication with said conveyor means for conducting said mixture from said chamber;

a plenum connected to said discharge conduit for receiving material from said chamber;

a plenum discharge conduit;

means for introducing fluidizing air into said plenum for pneumatically conveying said mixture to said plenum discharge conduit; and a loading conduit connected to said plenum discharge conduit for conveying said mixture to said material distribution means for recirculating and remixing said mixture.

* * * * *